US007834841B2

(12) United States Patent
Harada

(10) Patent No.: US 7,834,841 B2
(45) Date of Patent: Nov. 16, 2010

(54) DISPLAY DRIVE DEVICE, DISPLAY DEVICE HAVING THE SAME AND METHOD FOR DRIVING DISPLAY PANEL

(75) Inventor: Takahiro Harada, Hino (JP)

(73) Assignee: Casio Computer Co., Ltd., Tokyo (JP)

( * ) Notice: Subject to any disclaimer, the term of this patent is extended or adjusted under 35 U.S.C. 154(b) by 1144 days.

(21) Appl. No.: 11/445,824

(22) Filed: Jun. 2, 2006

(65) Prior Publication Data

US 2006/0274028 A1 Dec. 7, 2006

(30) Foreign Application Priority Data

Jun. 3, 2005 (JP) ..... 2005-163874

(51) Int. Cl.
*G09G 3/36* (2006.01)

(52) U.S. Cl. ..... 345/103

(58) Field of Classification Search ..... 345/103
See application file for complete search history.

(56) References Cited

U.S. PATENT DOCUMENTS

| | | | | |
|---|---|---|---|---|
| 5,113,181 | A * | 5/1992 | Inoue et al. | 345/84 |
| 5,959,600 | A | 9/1999 | Uchino et al. | |
| 6,252,580 | B1 * | 6/2001 | Harrington | 345/582 |
| 6,452,580 | B1 * | 9/2002 | Edwards et al. | 345/100 |
| 6,703,994 | B2 * | 3/2004 | Edwards | 345/87 |
| 6,989,810 | B2 * | 1/2006 | Morita | 345/98 |
| 7,034,797 | B2 | 4/2006 | Maki | |
| 7,701,426 | B2 | 4/2010 | Yokoyama et al. | |
| 2001/0020929 | A1 | 9/2001 | Nagata et al. | |

(Continued)

FOREIGN PATENT DOCUMENTS

EP 0737957 A1 10/1996

(Continued)

OTHER PUBLICATIONS

Korean Office Action (and English translation thereof) dated Jun. 23, 2008, issued in a corresponding Korean Office Action.

(Continued)

*Primary Examiner*—Richard Hjerpe
*Assistant Examiner*—Dorothy Webb
(74) *Attorney, Agent, or Firm*—Holtz, Holtz, Goodman & Chick, PC

(57) ABSTRACT

A display drive device which drives a display panel based on display data, the display panel including a plurality of scan lines and a plurality of signal lines, the signal lines being divided into a plurality of signal line groups, each of the signal line groups including a predetermined number of signal lines, a display signal generation circuit section which sequentially outputs display signal voltages based on the display data in a time sharing manner within each horizontal scanning period, and a selection circuit section which sequentially selects the signal line group corresponding to the display signal voltages output from the display signal generation circuit section in synchronization with an output timing of the display signal voltages, and applies the display signal voltages to the plurality of signal lines constituting the selected signal line group. The selection circuit section applies the display signal voltages to each signal line group plural times within each horizontal scanning period.

21 Claims, 11 Drawing Sheets

| | VCOM | RED LINE | GREEN LINE | BLUE LINE |
|---|---|---|---|---|
| ~ t21 | 4.5V | 4.3V | 0.3V | 0.3V |
| t22 | -1.5V | 0.3V | 0.3V | 0.3V |
| t23 | -1.5V | 0.470V (=0.3V+0.170V) | 3.9V | 0.470V (=0.3V+0.170V) |
| t24 | -1.5V | 0.631V (=0.470V+0.161V) | 4.061V (=3.9V+0.161V) | 3.9V |
| t25 | -1.5V | 0.3V | 4.045V (=4.061V-0.016V) | 3.884V (3.9V-0.016V) |
| t26 | -1.5V | 0.314V (=0.3V+0.014V) | 4.3V | 3.898V (3.884V+0.014V) |
| t27 | -1.5V | 0.333V (=0.314V+0.019V) | 4.319V (=4.3V+0.019V) | 4.3V |
| t28 | -1.5V | 0.333V | 4.319V | 4.3V |

U.S. PATENT DOCUMENTS

| | | | | |
|---|---|---|---|---|
| 2003/0006946 | A1 * | 1/2003 | Ichikawa | 345/74.1 |
| 2003/0132907 | A1 | 7/2003 | Lee et al. | |
| 2004/0017341 | A1 * | 1/2004 | Maki | 345/87 |
| 2004/0080522 | A1 * | 4/2004 | Nitta et al. | 345/690 |
| 2004/0263760 | A1 * | 12/2004 | Kodate et al. | 349/151 |

FOREIGN PATENT DOCUMENTS

| | | | |
|---|---|---|---|
| EP | 1069457 | A1 | 1/2001 |
| GB | 2 384 102 | A | 7/2003 |
| JP | 10-319924 | A | 12/1998 |
| JP | 2003-122313 | A | 4/2003 |
| JP | 2003-167556 | A | 6/2003 |
| JP | 2004-012944 | A | 1/2004 |
| JP | 2004-037498 | A | 2/2004 |
| JP | 2004-045989 | A | 2/2004 |
| JP | 2004-093887 | A | 3/2004 |
| JP | 2005-115342 | A | 4/2005 |
| JP | 2005-351963 | A | 12/2005 |
| JP | 2005351963 | A * | 12/2005 |

OTHER PUBLICATIONS

Japanese Office Action dated May 18, 2010 (3 pages), and English translation thereof (4 pages), issued in counterpart Japanese Application Serial No. 2005-163874.

* cited by examiner

| TIME | VCOM | RED LINE | GREEN LINE | BLUE LINE |
|---|---|---|---|---|
| ~t11 | 4.5V | 4.3V | 0.3V | 0.3V |
| t12 | -1.5V | 0.3V | 0.3V | 0.3V |
| t13 | -1.5V | 0.489V (=0.3V+0.189V) | 4.3V | 0.489V (=0.3V+0.189V) |
| t14 | -1.5V | 0.663V (=0.484V+0.179V) | 4.479V (=4.3V+0.179V) | 4.3V |

| | VCOM | RED LINE | GREEN LINE | BLUE LINE |
|---|---|---|---|---|
| ~ t21 | 4.5V | 4.3V | 0.3V | 0.3V |
| t22 | -1.5V | 0.3V | 0.3V | 0.3V |
| t23 | -1.5V | 0.470V (=0.3V+0.170V) | 3.9V | 0.470V (=0.3V+0.170V) |
| t24 | -1.5V | 0.631V (=0.470V+0.161V) | 4.061V (=3.9V+0.161V) | 3.9V |
| t25 | -1.5V | 0.3V | 4.045V (=4.061V-0.016V) | 3.884V (3.9V-0.016V) |
| t26 | -1.5V | 0.314V (=0.3V+0.014V) | 4.3V | 3.898V (3.884V+0.014V) |
| t27 | -1.5V | 0.333V (=0.314V+0.019V) | 4.319V (=4.3V+0.019V) | 4.3V |
| t28 | -1.5V | 0.333V | 4.319V | 4.3V |

DISPLAY DRIVE DEVICE, DISPLAY DEVICE HAVING THE SAME AND METHOD FOR DRIVING DISPLAY PANEL

BACKGROUND OF THE INVENTION

1. Field of the Invention

The present invention relates to a display drive device which drives a display panel based on display data, a display device having the display drive device, and a method for driving a display panel.

2. Description of the Related Art

In an active matrix type liquid crystal display device, a plurality of scan lines and a plurality of signal lines are laid out on a liquid crystal display panel in such a manner as to be orthogonal to one another, and display pixels are formed in the vicinity of individual intersections. Each display pixel has a liquid crystal capacitor where a liquid crystal is filled between a pixel electrode, connected to the signal line and the scan line via a TFT (Thin Film Transistor), and a common electrode.

In such a liquid crystal display device, as scan signals (gate pulses) are sequentially applied to individual scan lines by a scan driver so as to be a selected state, the TFTs of corresponding display pixels become an ON state. A display signal voltage applied to each signal line by a signal driver is then applied to the pixel electrode through the TFT. Accordingly, a voltage difference between the display signal voltage and a common signal voltage VCOM applied to the common electrode is applied to a corresponding liquid crystal capacitor, charged in the liquid crystal capacitor, so that orientation states of liquid crystal molecules are controlled. Therefore, a desired image is displayed on the liquid crystal display panel.

FIG. 13 is a diagram illustrating an example of wirings of drivers and a display pixel section in the liquid crystal display device.

As illustrated in FIG. 13, a liquid crystal display device 9 is formed on, for example, a glass substrate 90. The liquid crystal display device 9 has a display pixel section 91 in which display pixels are arrayed, a signal driver 92 and a scan driver 94. Because of a demand of narrowing the right and left width of the glass substrate 90 without changing the size of the display pixel section 91, the signal driver 92 and the scan driver 94 arranged with each other may be disposed on the glass substrate 9 only at one edge side of the display pixel section 91 as illustrated in FIG. 13. At this time, a plurality of signal lines 93 and a scan line 95 are wired in such a way that both the signal driver 92 and scan driver 94 are connected to the display pixel section 91. At this time, an interwiring capacitor as a parasitic capacitor is provided between each signal line 93 and each scan line 95.

In such an arrangement, as the number of signal lines 93 increases, or a clearance between the signal driver 92 and the display pixel section 91 becomes narrow, a portion where the density of the wirings of the signal lines 93 becomes high is created. In FIG. 13, the signal driver 92 is disposed on the left side, and the scan driver 94 is disposed on the right side. Therefore, the wirings of the signal lines 93 becomes longer in wiring length and narrower in pitch (interval) rightward. That is, a region B has a longer wiring length and a narrower pitch than a region A. At this time, the interwiring capacitor created between the signal lines 93 in the region B becomes larger than the interwiring capacitor created between the signal lines 93 in the region A.

FIG. 14A is an example of a cross-sectional view of the wiring portions of the signal lines 93 in the liquid crystal display device 9 illustrated in FIG. 13, and FIG. 14B is an equivalent circuit diagram thereof.

As illustrated in FIG. 14A, the wiring portions of the signal lines 93 employ a structure that, for example, the linear signal lines 93 made of a metal, such as Cr or Al are formed on an SiN nitride film 96 formed as an insulating film on the glass substrate 90 at intervals, and an SiN nitride film 97 is formed thereover, so that a space between signal lines 93 is insulated, and the upper portion is covered by a seal material 98.

That is, as illustrated in FIG. 14B, the interwiring capacitance of the signal line 93 is the combined capacitance of a capacitance Cx originated from the glass substrate 90, a capacitance Cy originated from the SiN nitride films 96, 97, and a capacitance Cz originated from the seal material 98. The longer the wiring length of the signal line 93 is or the narrower the pitch is, the larger the interwiring capacitance becomes. That is, the higher the density of the signal lines 93 becomes and the longer the wiring length becomes, the larger the interwiring capacitance of the signal line 93 becomes.

Recently, higher definition of the liquid crystal display panel is remarkable, and an increment in signal line number originated from the higher definition raises a problem that the electrical power consumption of the signal driver increases and the cost increases. As a method of driving and controlling the liquid crystal display panel to prevent the problem, a scheme of grouping a plurality of signal lines into predetermined numbers of signal lines (for example, three lines), sequentially selecting each predetermined number thereof, and driving the panel in a time sharing manner may be employed.

In a case where such time-shared driving is applied to the liquid crystal display device 9 having the arrangement as illustrated in FIG. 13, the voltage of the signal line 93 in a non-selected state may change when the display signal voltage is applied depending on the interwiring capacitor.

SUMMARY OF THE INVENTION

The present invention has an advantage that can suppress the deterioration of an image originated from an interwiring capacitor between signal lines when a plurality of signal lines of a display panel are driven in a time sharing manner in a display drive device which drives the display panel including a plurality of scan lines and the plurality of signal lines based on display data and a display device having the display drive device.

To achieve the advantage, a display drive device according to an aspect of the present invention is a display drive device which drives a display panel based on display data, comprising:

the display panel including a plurality of scan lines and a plurality of signal lines, the signal lines being divided into a plurality of signal line groups, each of the signal line groups including a predetermined number of signal lines, a display signal generation circuit section which sequentially outputs display signal voltages based on the display data in a time sharing manner within each horizontal scanning period; and a selection circuit section which sequentially selects the signal line group corresponding to the display signal voltages output from the display signal generation circuit section in synchronization with an output timing of the display signal voltages, and applies the display signal voltages to the plurality of signal lines constituting the selected signal line group, wherein the selection circuit section applies the display signal voltages to each signal line group plural times within each horizontal scanning period.

To achieve the advantage, a display device according to another aspect of the present invention is a display device which displays image information based on display data comprising:

a display panel including a plurality of scan lines, a plurality of signal lines and display pixels each two-dimensionally arrayed in a vicinity of an intersection of each scan line and each signal line, the signal lines being divided into signal line groups, each of the signal line groups including a predetermined number of signal lines;

a scan side drive circuit which sequentially outputs a scan signal to the plurality of scan lines, and sequentially sets the display pixels at selected states; and a signal side drive circuit including a display signal generation circuit section which sequentially outputs display signal voltages based on the display data in a time sharing manner within each horizontal scanning period, and a selection circuit section which sequentially selects the signal line group corresponding to the display signal voltages output from the display signal generation circuit section in synchronization with an output timing of the display signal voltages, and applies the display signal voltages to the plurality of signal lines constituting the selected signal line group, wherein the selection circuit section of the signal side drive circuit applies the display signal voltages to each signal line group plural times within each horizontal scanning period.

To achieve the advantage, a method according to an aspect of the present invention is a method of driving a display panel based on display data, comprising:

the display panel having a plurality of scan lines and a plurality of signal lines, the signal lines being divided into a plurality of signal line groups, each of the signal line groups including a predetermined number of signal lines, capturing the display data and holding the captured display data;

sequentially outputting display signal voltages based on the held display data in a time sharing manner within each horizontal scanning period; and sequentially selecting, in synchronization with an output timing of the display signal voltages, the signal line group corresponding to the output display signal voltages, and applying the display signal voltages to the plurality of signal lines constituting the selected signal line group applying the display signal voltages to each signal line group plural times within each horizontal scanning period.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

A display drive device, a drive control method therefor, and a display device having the display drive device according to the invention will be explained in detail based on embodiments illustrated in drawings.

First, the embodiment of a liquid crystal display device to which the display drive device of the invention is applied will be explained.

[Display Device]

Figure 1:
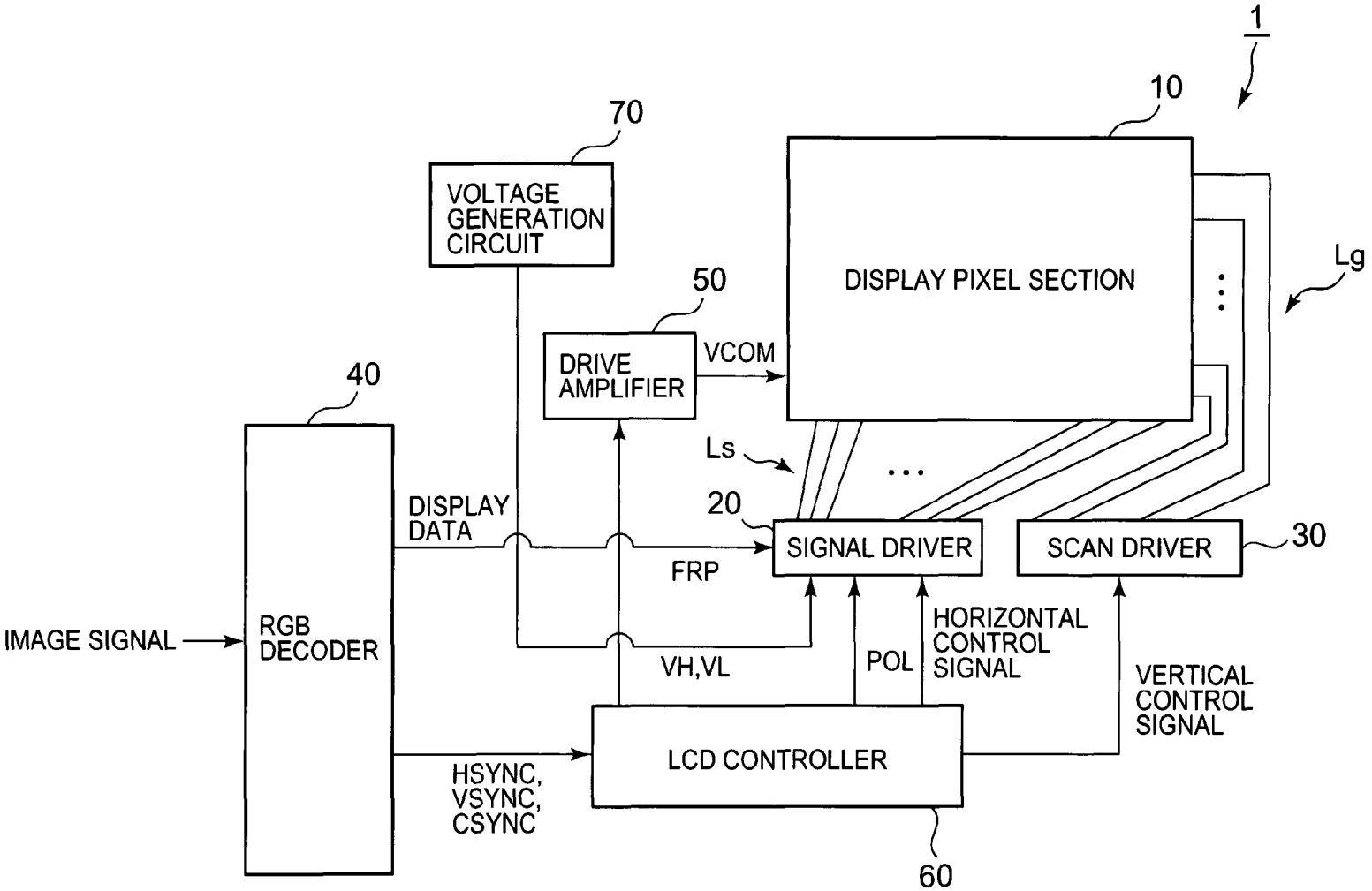
FIG. 1 is a block diagram illustrating the general structure of an embodiment of a liquid crystal display device to which a display drive device according to the invention is applied.

FIG. 1 is a block diagram illustrating the general structure of the embodiment of the liquid crystal display device to which the display drive device according to the invention is applied.

Figure 2:
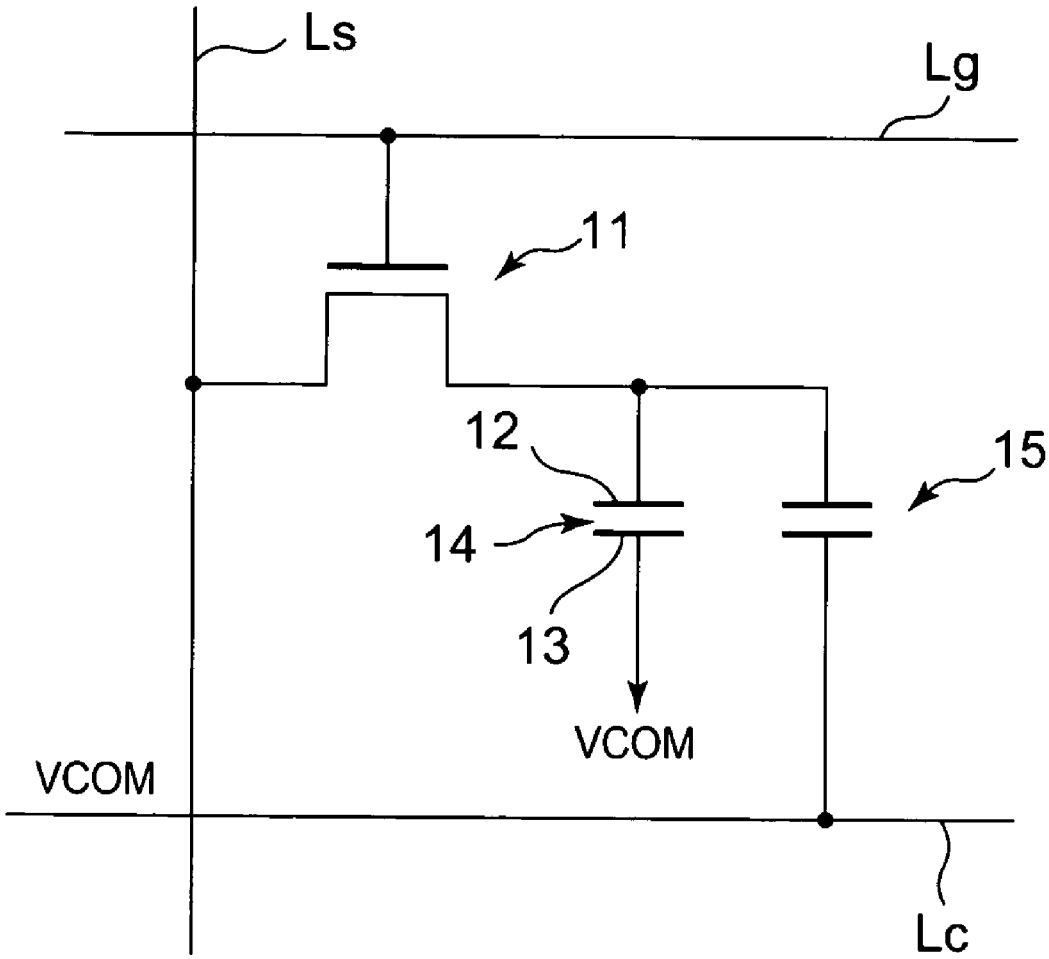
FIG. 2 is an equivalent circuit diagram of a display pixel.

FIG. 2 is an equivalent circuit diagram of a display pixel.

Figure 13:
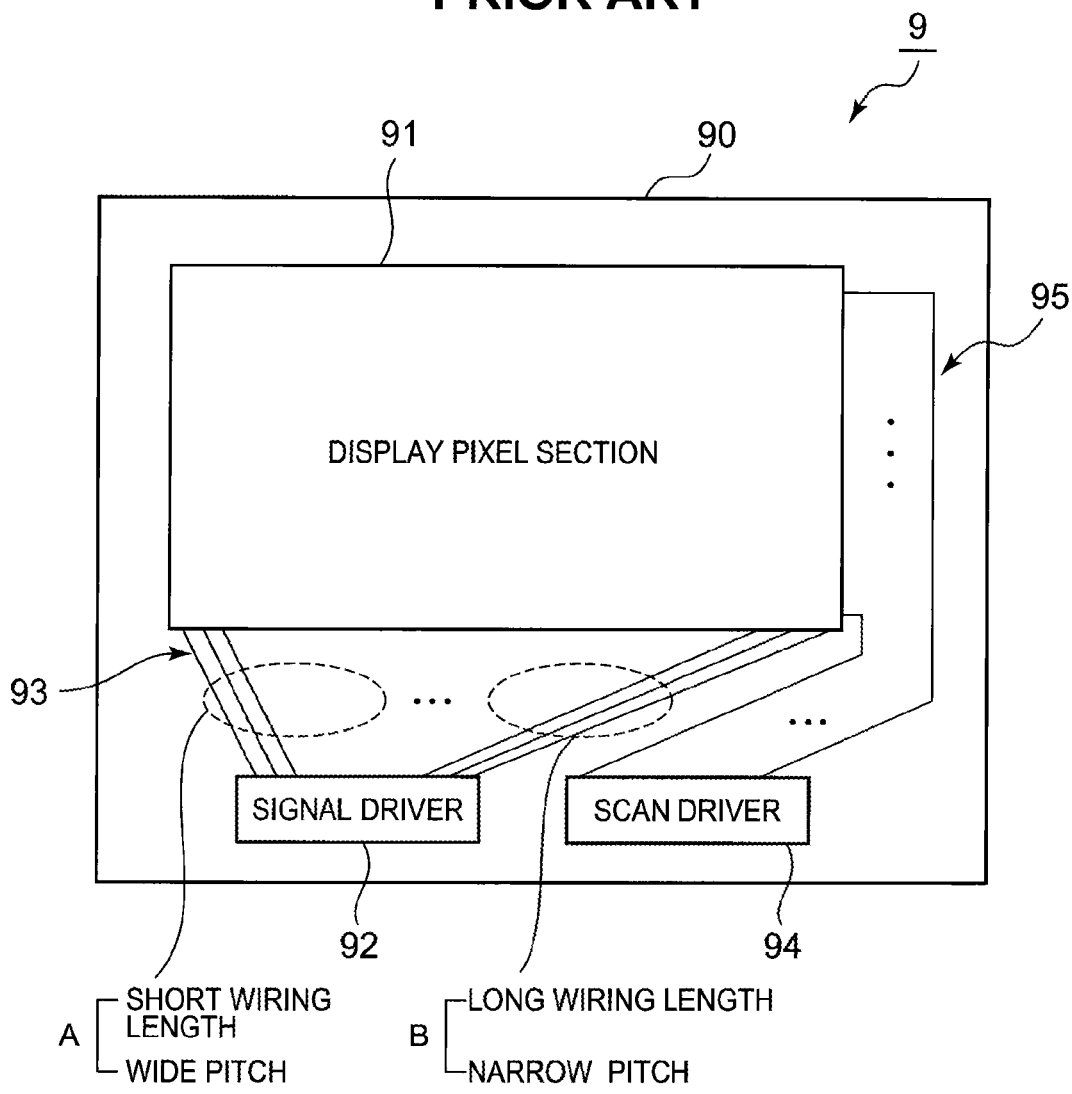
FIG. 13 PRIOR ART
FIG. 13 is a diagram illustrating an example of wirings of drivers and a display pixel section in a liquid crystal display device.
Figure 14A:
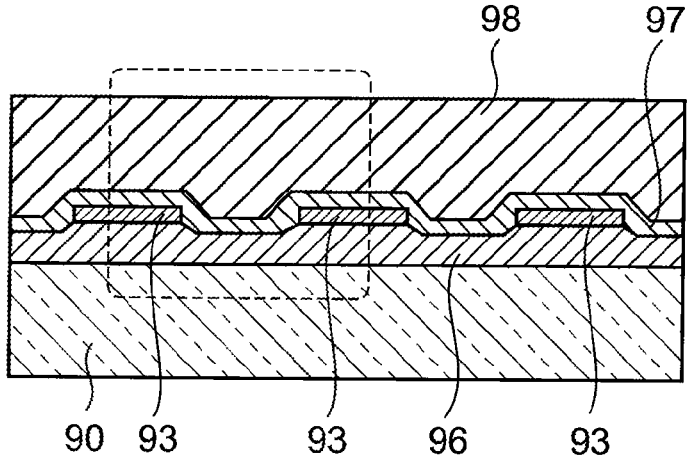
FIG. 14A PRIOR ART
FIGS. 14A and 14B are cross sectional diagrams of the wiring portions of signal lines and an equivalent circuit diagram thereof, respectively.
Figure 14B:
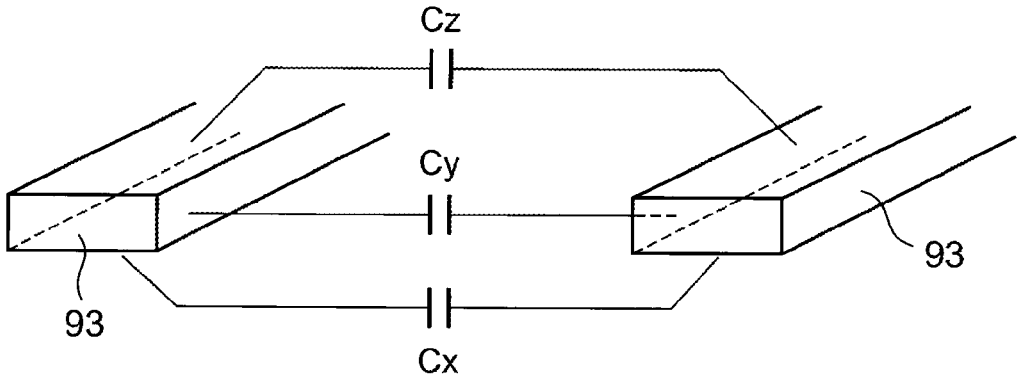
FIG. 14B PRIOR ART

As illustrated in FIG. 1, a liquid crystal display device 1 comprises a display pixel section 10, a signal driver (signal side driving circuit: display drive device) 20, a scan driver (scan side driving circuit) 30, an RGB decoder 40, a drive amplifier 50, an LCD controller 60, and a voltage generation circuit 70. At least the display pixel section 10, the signal driver 20, and the scan driver 30 are provided on a non-illustrated glass substrate like in the structure illustrated in FIG. 13.

The display pixel section 10 is provided with a plurality of scan lines Lg connected to the scan driver 30 and arranged along a row direction. The display pixel section 10 is also provided with a plurality of signal lines Ls connected to the signal driver 20 and arranged along the column direction in such a manner as to be orthogonal to each scan line Lg. A plurality of display pixels are two dimensionally arrayed near individual intersections of the scan lines Lg and the signal lines Ls.

As illustrated in FIG. 2, the display pixel comprises a TFT (Thin Film Transistor) 11 as an active element, a pixel electrode 12 connected to the scan line Lg and the signal line Ls through the TFT 11, a counter electrode 13 disposed at a position opposite to the pixel electrode 12 and to which a common signal voltage VCOM is applied, a pixel capacitor (liquid crystal capacitor) 14 constituted by filling a liquid crystal between the pixel electrode 12 and the counter electrode 13, an auxiliary capacitor 15 provided in such a manner as to be parallel to the pixel capacitor 14, and holds a display signal voltage to be applied to the pixel capacitor 14 from the signal line Ls through the TFT 11, and an auxiliary capacitor line (common line) Lc connected to the auxiliary capacitor 15 and to which a common signal voltage VCOM is applied.

When scan signals (gate pulses) are sequentially applied to individual scan lines Lg by the scan driver 30 so that the line becomes a selected state (high potential state), the TFT 11 of each corresponding display pixel is turned ON. A display signal voltage applied to the signal line Ls from the signal driver 20 is applied to each pixel electrode 12 through the TFT 11. A voltage difference between the display signal voltage and a common signal voltage VCOM applied to the counter electrode 13 is charged in the pixel capacitor 14 of each display pixel. The orientation states of liquid crystal molecules in each display pixel are controlled in accordance with the voltage difference. Accordingly, a desired image is displayed on the liquid crystal display panel 10.

In FIG. 1, the signal driver 20 is connected to the signal line Ls. The signal driver 20 applies the display signal voltage to each signal line Ls based on display data supplied from the RGB decoder 40 based on a horizontal control signal to be input from the LCD controller 60. The detailed structure of the signal driver 20 will be discussed later.

The scan driver 30 is connected to the scan lines Lg. The scan driver 30 sequentially applies a scan signal to the individual scan lines Lg, to set those lines in a selected state, based on a vertical control signal input from the LCD controller 60.

The RGB decoder 40 extracts a horizontal synchronization signal HSYNC, a vertical synchronization signal VSYNC and a composite synchronization signal CSYNC from an image signal to be input from outside the liquid crystal display device 1, and outputs those signals to the LCD controller 60. At the same time, the RGB decoder 40 extracts display data for each color of R (Red), G (Green), and B (Blue) from the image signal, and outputs the data to the signal driver 20.

The drive amplifier 50 generates a common signal voltage VCOM to be applied to the common line Lc commonly connected to the auxiliary capacitor 15 of each display pixel in the liquid crystal display panel 10 and the counter electrode 13. The drive amplifier 50 inverts the polarity of the generated common signal voltage VCOM in accordance with a polarity inversion control signal FRP to be input from the LCD controller 60, and outputs a common signal voltage VCOM to the display pixel section 10.

The LCD controller 60 generates a polarity control signal POL based on the horizontal synchronization signal HSYNC, the vertical synchronization signal VSYNC, and the composite synchronization signal CSYNC, and outputs it to the signal driver 20. The LCD controller 60 generates a horizontal control signal including a clock signal SCK, a shift start signal STH, and a latch operation control signal STB, and outputs it to the signal driver 20. The LCD controller 60 generates a vertical control signal, and outputs it to the scan driver 30. Thus, the LCD controller 60 sequentially has the display pixels of the liquid crystal display panel 10 selected at predetermined timings, applies the display signal voltage to the display pixel set in the selected state, and has a predetermined image based on display data displayed.

The voltage generation circuit 70 generates and supplies a voltage necessary for each part of the liquid crystal display device 1. For example, the voltage generation circuit 70 generates voltages VH, VL necessary for a gradation voltage generation section 29 in the signal driver 20 illustrated in FIG. 3 to generate a gradation voltage.

[Signal Driver]

Figure 3:
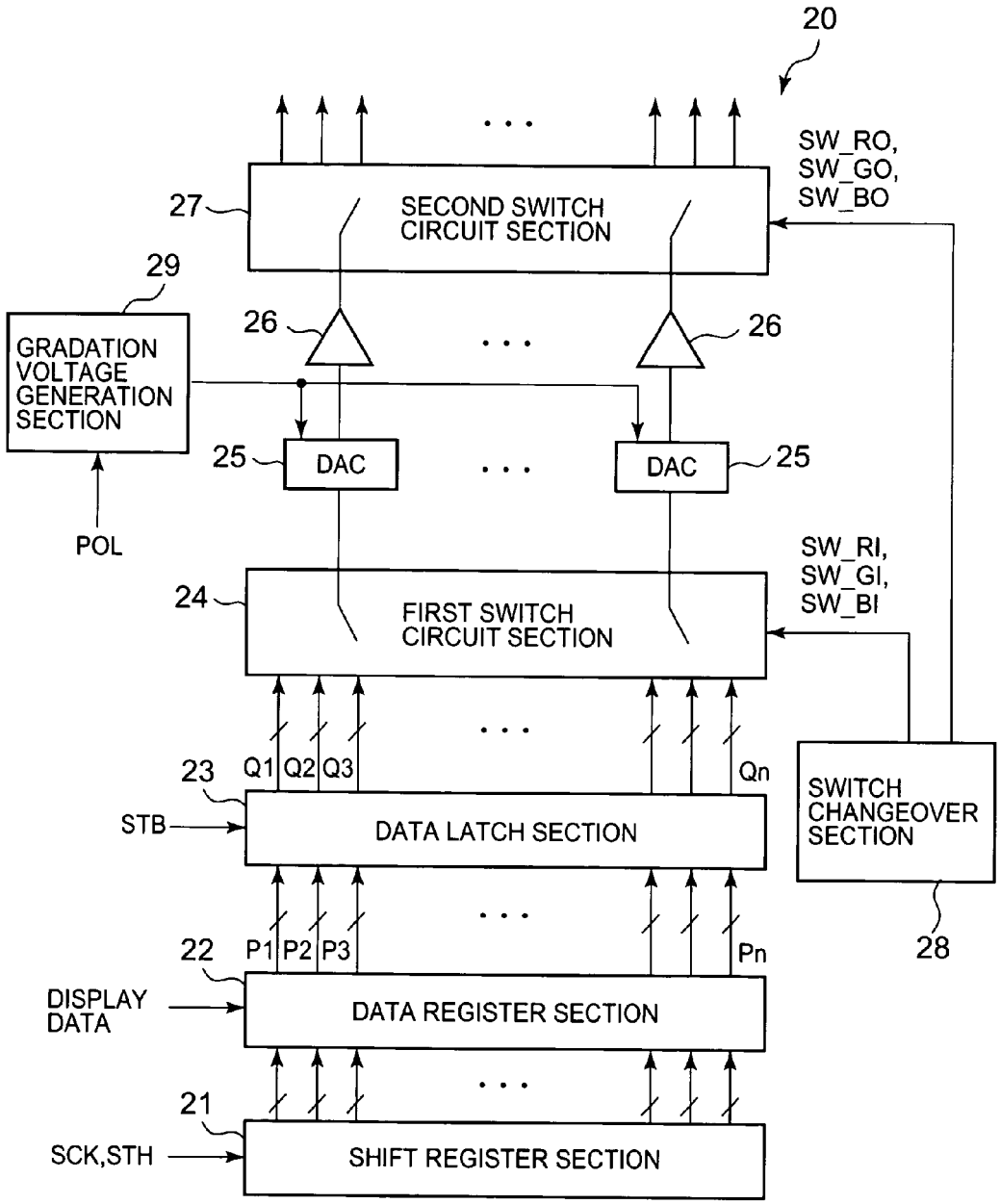
FIG. 3 is a circuit structure diagram of a signal driver in the embodiment.

FIG. 3 is a relevant part structure diagram of the signal driver 20 of the embodiment.

According to the figure, the signal driver 20 comprises a shift register section 21, a data register section 22, a data latch section (data holding section) 23, a first switch circuit section 24, a plurality of DACs (display signal generation circuit) 25, a plurality of output amplifiers 26, a second switch circuit section (selection circuit section) 27, a switch changeover section 28, and the gradation voltage generation section 29.

The data latch section 23, the first switch circuit section 24, the DACs 25 and the output amplifiers 26 constitutes a display signal generation circuit section of the invention.

The shift register section 21 sequentially shifts the shift start signal STH included in the horizontal control signal to be input from the LCD controller 60 by the clock signal SCK likewise included in the horizontal control signal, and outputs it to the data register section 22 as the timing signal.

The data register section 22 sequentially captures display data comprised of digital signals to be input from the RGB decoder 40 in synchronization with a timing signal to be input from the shift register section 21, and output them as display data P1, P2, . . . , Pn. Here, "n" equals to the number of the signal lines Ls provided on the liquid crystal display panel 10.

The data latch section 23 simultaneously captures the display data P1, P2, . . . , Pn to be input from the data register section 22 in accordance with the latch operation control signal STB included in the horizontal control signal to be input from the LCD controller 60. The data latch section 23 outputs the captured display data P1, P2, . . . , Pn as display data Q1, Q2, . . . , Qn to the n display data output lines, respectively.

The first switch circuit section 24 has a plurality of switches for changing over connections between a plurality of display data output lines of the data latch section 23 and the plurality of DACs 25. The first switch circuit section 24 selects one display data output line in accordance with first switch control signals SW_RI, SW_GI, and SW_BI input to the first switch circuit section 24 from the switch changeover section 28 for each set of three output lines to which display data of the individual colors of, for example, red, green, and blue are output be a set among the n display data output lines from the data latch section 23 by changing over the switch, connects it to the DAC 25 at the subsequent stage, and has the other two display data output lines non selected. The first switch control signals SW_RI, SW_GI, and SW_BI are respectively associated with the display data output lines for red, green, and blue.

The DAC 25 converts the display data input from the first switch circuit section 24 to an analog signal voltage based on the gradation voltage supplied from the gradation voltage generation section 29. The DAC 25 amplifies the converted analog signal voltage as a display signal voltage through the output amplifier 26, and then outputs it to the second switch circuit section 27.

The second switch circuit section 27 has a plurality of switches for changing over connections between the plurality of output amplifiers 26 and the plurality of signal lines Ls. The second switch circuit section 27 selects one signal line Ls according to second switch control signals SW_RO, SW_GO, and SW_BO input from the switch changeover section 28 to the second switch circuit section 27 for each set of three adjoining signal lines Ls of a red line that is a signal line Ls to which a red display signal voltage is applied, a green line that is a signal line Ls to which a green display signal voltage is applied, and a blue line that is a signal line Ls to which a blue display signal voltage is applied among the n signal lines Ls by changing over the switch, connects it to the forehead DAC 25, and set the other two signal lines in a non selected state. The second switch control signals SW_RO, SW_GO, and SW_BO are respectively associated with the signal lines Ls of the red line, the green line, and the blue line.

In the embodiment, the first switch circuit section 24 has the three display data output lines be a set, and the second switch circuit section 27 has the three signal lines Ls a set, but the invention is not limited to this case. For example, the two display data output lines and the two signal lines Ls may be individually a set, the greater than or equal to four display data output lines or signal lines Ls may be individually a set.

The switch changeover section 28 generates the first switch control signals SW_RI, SW_GI, and SW_BI, outputs them to the first switch circuit section 24, generates the second switch control signals SW_RO, SW_GO, and SW_BO, and outputs them to the second switch circuit section 27. At this time, the first switch control signals SW_RI, SW_GI, and SW_GI, and the second switch control signals SW_RO, SW_GO, and SW_BO are changed over in such a way that the connection states of the sets in the first switch circuit section 24 and the second switch circuit section 27 are synchronized with each other, and the connection state of each set takes a round at least one time within one horizontal scanning period. Because of such settings of the first switch control signals SW_RI, SW_GI, and SW_BI and the second switch control signals SW_RO, SW_GO, and SW_BO, it is structured in such a way that an operation of applying a display signal voltage to each signal line Ls is driven in a time sharing manner.

The red lines in each set selected by the second switch control signal SW_RO are every three lines of the n signal lines Ls, so that the number thereof is n/3. Likewise, the green lines in each set selected by the second switch control signal SW_BO are every three lines of the n signal lines Ls, so that the number thereof is n/3, and, the blue lines in each set selected by the second switch control signal SW_BO are every three lines of the n signal lines Ls, and the number thereof is n/3. The red lines, green lines and blue lines in each set constitute signal line groups of the invention. That is, in the embodiment, the n signal lines Ls comprise a signal line group constituted by the n/3 numbers of the red lines, a signal line constituted by the n/3 numbers of the green lines, and a signal line group constituted by the n/3 numbers of the blue lines.

The gradation voltage generation section 29 divides voltages into voltages VH and VL supplied from the voltage generation circuit 70 by a plurality of resistors according to a gradation number of the display data (for example, 256), in accordance with the polarity control signal POL input from the LCD controller 60. The gradation voltage generation section 29 supplies each divided voltage as a gradation voltage to each DAC 25.

[Interwiring Capacitors]

Various capacitor components originated from the aforementioned interwiring capacitor and parasitic capacitor are provided for each signal line Ls of the liquid crystal display device 1.

Figure 4:
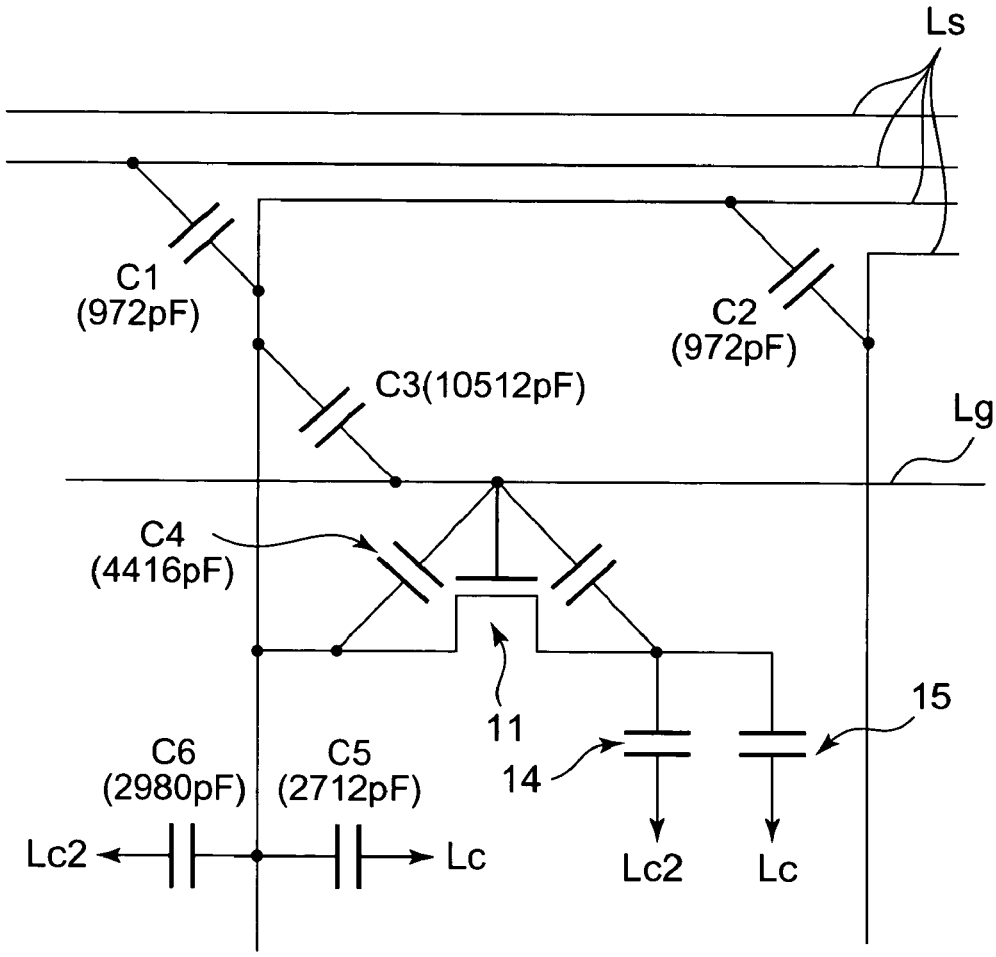
FIG. 4 is an equivalent circuit diagram of a display pixel for explaining capacitor components produced in signal lines.

FIG. 4 illustrates an equivalent circuit of one display pixel for explaining capacitor components generated for the signal lines Ls.

Figure 5:
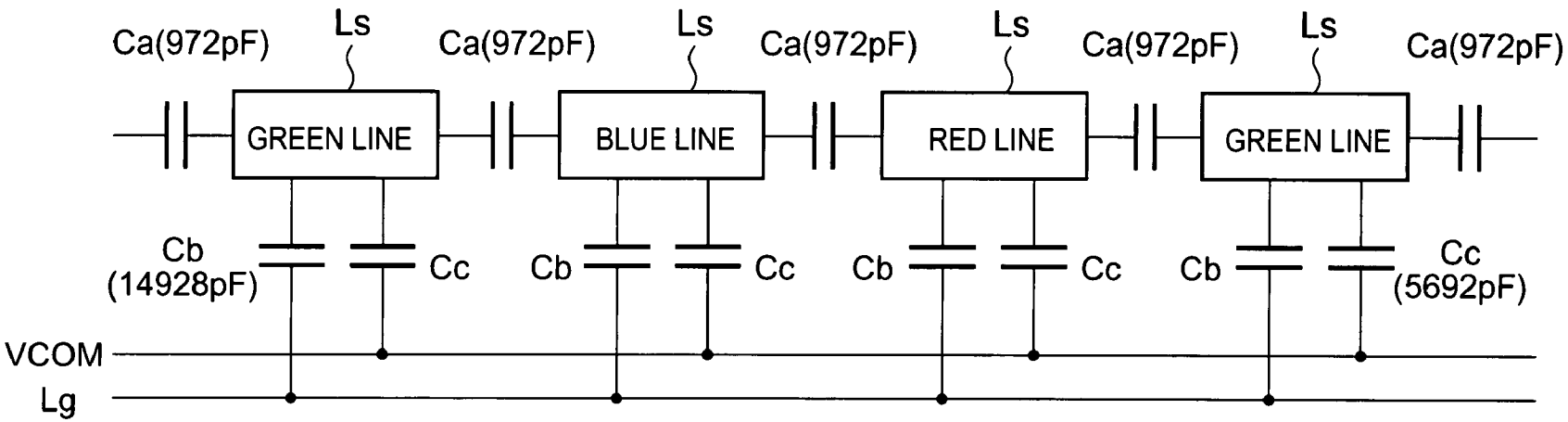
FIG. 5 is an equivalent circuit diagram for explaining voltage changes in signal lines.

FIG. 5 illustrates an equivalent circuit for explaining voltage changes in the signal lines Ls.

The value of each capacitance in FIGS. 4 and 5 are an example. As illustrated in FIG. 4, generated for the signal lines Ls as capacitor components in each display pixel are capacitances (interwiring capacitors) C1, C2 between the adjoining signal lines Ls sandwiching the display pixel, a capacitance C3 between the signal line Ls and the scan line Lg, a capacitance C4 between the gate and drain of the TFT 11, a capacitance C5 between the signal line Ls and the auxiliary capacitor line Lc, and a capacitance C6 between the signal line Ls and the counter electrode 13. Therefore, the equivalent circuit in focusing the signal lines Ls becomes as illustrated in FIG. 5.

As illustrated in FIG. 5, generated as capacitances parasitizing the signal lines Ls are capacitances Ca each of which is between two signal lines Ls corresponding to the capacitances C1, C2, capacitor components Cb between the signal line Ls and the scan line Lg corresponding to a composite capacitance of the capacitances C3, C4, and capacitor components Cc each of which is between the signal line Ls and the counter electrode 13 (common voltage signal VCOM) corresponding to a composite capacitance of the capacitances C5, C6.

According to the equivalent circuit, when a voltage change originated from voltage application or the like occurs at a signal line Ls, a charge transfer according to the product of the voltage change and the interwiring capacitance Ca occurs at an adjoining signal line Ls, so that the voltages of the adjacent signal line Ls fluctuates. That is, provided that a voltage change of a signal line Ls is ΔV, a voltage fluctuation ΔE of an adjacent signal line will be given by the following equation.

$$\Delta E=(Ca/(Cb+Cc))\times\Delta V \quad (1)$$

The interwiring capacitance Ca is smaller than the capacitances Cb, Cc in a conventional liquid crystal display device that the wiring density of the signal line Ls is not so large. Accordingly, the voltage change ΔE of the signal line Ls originated from the interwiring capacitor is smaller as to be negligible than the display signal voltage applied to each signal line Ls.

However, as the interwiring capacitance Ca increases because of the density growth of the wiring density of the signal line Ls, the voltage change ΔE increases along with that. The increment of the ΔE is a factor of the image degradation of a display image on the liquid crystal display panel 10.

First Embodiment

An explanation will be given of the first embodiment of the drive control method for the display device according to the invention for suppressing image degradation of the liquid crystal display device 1 that the signal lines Ls are wired at a high density originated from the interwiring capacitance Ca, in comparison with a conventional drive control method.

An explanation will be given of a case where a low level voltage (0.3 V) is applied to the red line and high level voltages (4.3 V) are applied to the green line and the blue line as the display signal voltages with a high level voltage (4.3 V) having been applied to the red line and low level voltages (0.3 V) having been applied to the green line and the blue line in the horizontal scanning period, and each display signal voltage is applied in the order of the red line, the blue line, and the green line.

Provided that the values of the individual capacitances of each display pixel are ones illustrated in FIGS. 4 and 5. That is, in FIG. 4, the capacitances C1, C2 are "972 pF", the capacitance C3 is "10512 pF", the capacitance C4 is "4416 pF", the capacitance C5 is "2712 pF", and the capacitance C6 is "2980 pF". Therefore, for the capacitances Ca, Cb, and Cc in FIG. 5, the capacitance Ca is "972 pF", the capacitance Cb is "14928 pF", and the capacitance $C_c$ is "5692 pF", respectively.

First, for comparison, the voltage change of each signal-line Ls when the conventional drive control method is applied will be explained.

Figures 6, 7:
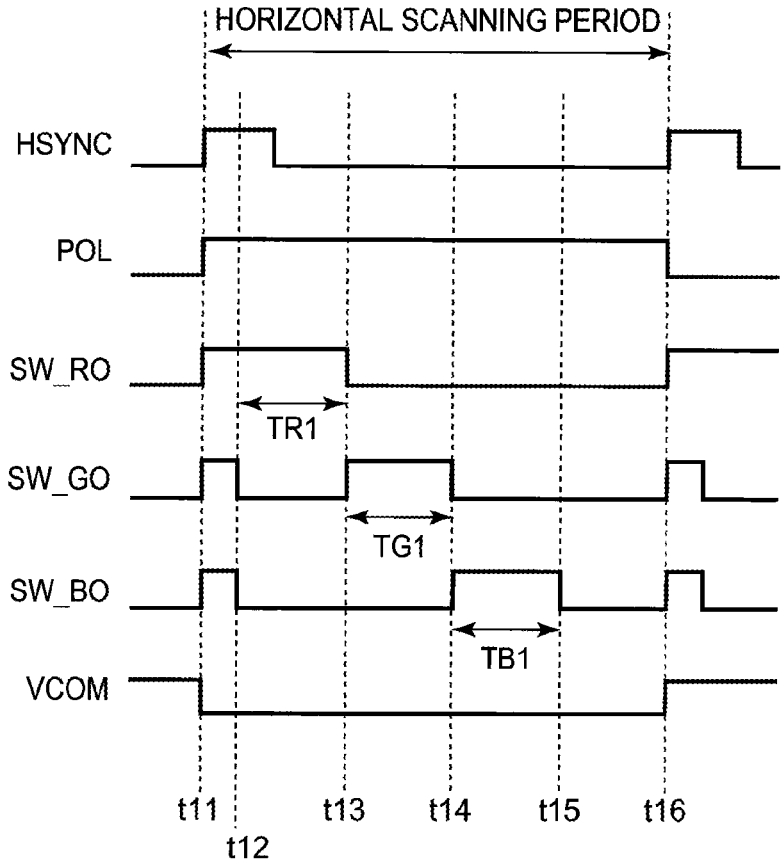
FIG. 6 PRIOR ART
FIG. 7 PRIOR ART
FIG. 6 is a timing chart for a case where a conventional drive control method is applied.
FIG. 7 is a diagram illustrating the voltage of each signal line in a case where the conventional drive control method is applied.

FIG. 6 is a timing chart for a case where the conventional drive control method is applied.

FIG. 7 is a diagram illustrating the voltages of the individual signal lines Ls in a case where a driving is performed with signal waveforms illustrated in FIG. 6.

In FIG. 6, beginning from the top, the waveforms of the horizontal synchronization signal HSYNC, the polarity control signal POL, the second switch control signals SW_RO, SW_GO, and SW_BO, and the common signal voltage VCOM are respectively illustrated.

First, provided that the common voltage signal VCOM is 4.5 V, the voltage of the red line is 4.3 V, the voltages of the green line and the blue line are both 0.3 V at a time point just before a time t11 as an initial state. In this state, a low level display signal voltage (0.3 V) is applied to the red line, and high level display signal voltages (4.3 V) are applied to the green line and the blue line.

At a time point of starting the horizontal scanning period, i.e., a time t 11 that the horizontal synchronization signal HSYNC changes to high level from low level, the polarity control signal POL changes from low level to high level, and the common voltage VCOM reverses its polarity, and changes to −1.5 V from 4.5 V. The second switch control signals SW_RO, SW_GO and SW_BO change to high level, and, it is not illustrated but the first switch control signal SW_RI changes to high level. Therefore, a low level voltage that is a display signal voltage applied to the red line, i.e., 0.3 V is applied to each of the red line, green line, and blue line, and the voltages of the red line, green line, and blue line become 0.3 V.

Afterward, at a time t12, the second switch control signals SW_GO, SW_BO change to low level. That is, the green line and the blue line become non selected states and become floating states, and hold 0.3 V of the prior voltages, respectively.

Next, at a time t 13, the second switch control signal SW_RO changes to low level, and the second switch control signal SW_GO changes to high level. Also, it is not illustrated but the first switch control signal SW_RI changes to low level, and the first switch control signal SW_GI changes to high level. Therefore, 4.3 V of a high level display signal voltage is applied to the green line, and the voltage of the green line becomes 4.3 V. As the red line becomes a floating state, 0.3 V of the prior voltage is held.

At this time, because of the interwiring capacitance Ca, the voltages of the adjacent red line and blue line change in accordance with the voltage change of the green line. Specifically, the voltage change ΔV of the green line is ΔV=4.0 V (=4.3 V−0.3 V), and according to the equation (1), the voltage fluctuation ΔE of an adjoining signal line Ls becomes 0.189 V. That is, the voltages of both of the red line and blue line change to 0.489 V (=0.3 V+0.189 V).

Subsequently, at a time t14, the second switch control signal SW_GO changes to low level, and the second switch control signal SW_BO changes to high level. It is not illustrated, but the first switch control signal SW_GI changes to low level, and the first switch control signal SW_BI changes to high level. Therefore, 4.3 V of a high level display signal voltage is applied to the blue line, and the voltage of the blue line becomes 4.3 V. The green line becomes a floating state, and 4.3 V of the prior voltage is held.

At this time, because of the interwiring capacitance Ca, the voltages of the adjacent red line and green line change in accordance with the voltage change of the blue line. Specifically, the voltage change ΔV of the blue line is ΔV=3.811 V (=4.3 V−0.489 V), and according to the equation (1), the voltage fluctuation ΔE of an adjoining signal line Ls becomes 0.179 V. That is, the voltage of the red line changes to 0.663 V (=0.484V+0.179 V), and the voltage of the green line changes to 4.479 V (=4.3 V+0.179V).

After that, at a time t15, the second switch control signal SW_BO changes to low level. Therefore, as the blue line becomes a floating state, 4.3 V of the prior voltage is held.

At a time point of ending the horizontal scanning period, i.e., a time point just before a time t16 where the horizontal synchronization signal HSYNC changes to high level from low level, the voltages of the red line, green line, and blue line become 0.663 V, 4.479 V, and 4.3 V, respectively. Meanwhile, the display signal voltages which have been applied to the red line, the green line, and the blue line are 0.3 V, 4.3 V, and 4.3 V, respectively.

That is, with respect to the applied display signal voltages, the voltages fluctuate at 0.363 V for the red line and 0.179 V for the green line. Because of the voltage fluctuations, the image degradation of a display image occurs.

The reason why the voltage fluctuation of the red line is largest and the voltage fluctuation of the green line is secondly larger is because the display signal voltages are applied in the order of the red line, the green line, and the blue line. That is, this is because that the red line is affected by the voltage change originated from the applications of the display signal voltages to the green line and the blue line after the display voltage is applied thereto, and in contrast, the green line is affected by the voltage change originated from the application of the display voltage to the blue line after the display voltage is applied thereto. Regarding the blue line, because the display signal voltage is lastly applied, it is not affected by the voltage changes of the other signal lines Ls.

A time when the second switch control signals SW_RO, SW_GO, and SW_BO are all high level, i.e., a time TR1 of applying the display signal voltage to the red line, a time TG1 of applying the display signal voltage to the green line, and a time TB1 of applying the display signal voltage to the blue line are almost equal. Each of the application times TR1, TG1, and TB1 is a sufficient time to change the voltage of each signal line Ls to the applied display signal voltage.

Next, voltage changes in a case where the first embodiment of the drive control method of the invention is applied will be explained.

Figure 8:
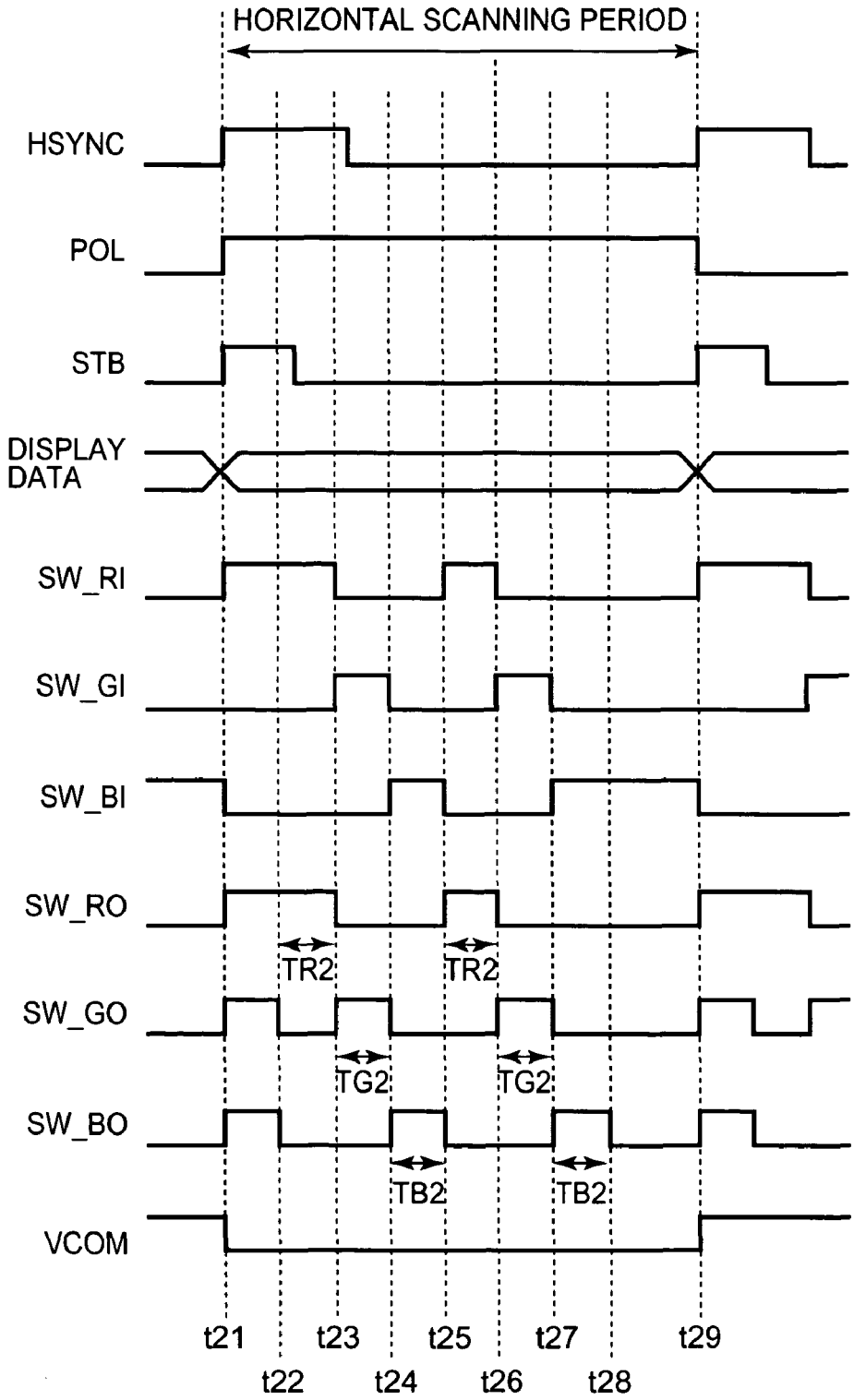
FIG. 8 is a timing chart for a case where the first embodiment of a drive control method is applied.

FIG. 8 is a timing chart for a case where the first embodiment of the drive control method is applied.

Figures 9, 10:
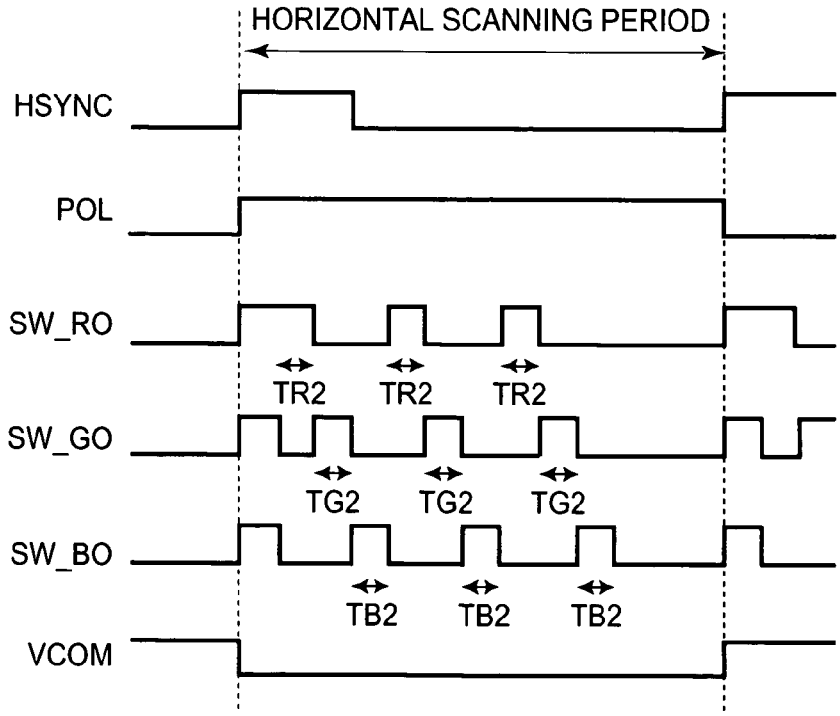
FIG. 9 is a diagram illustrating the voltage of each signal line in a case where the first embodiment of the drive control method is applied.
FIG. 10 is a timing chart for explaining another drive control method of first embodiment of the drive control method.

FIG. 9 is a diagram illustrating the voltages of the individual signal lines Ls in a case where a driving is performed by signal waveforms illustrated in FIG. 8.

In FIG. 8, beginning from the top, the waveforms of the horizontal synchronization signal HSYNC, the polarity control signal POL, the latch operation control signal STB, the display data, the first switch control signals SW_RI, SW_GI, SW_BI, the second switch control signals SW_RO, SW_GO, SW_BO, and the common voltage signal VCOM are respectively illustrated.

As illustrated in FIG. 8, in the embodiment, application of the display signal voltage to each signal line Ls is performed twice in one horizontal scanning period.

As similar to the case of FIGS. 6 and 7, first, as an initial state, at a time point just before a time t21, provided that the common voltage signal VCOM is 4.5 V, the voltage of the red line is 4.3 V, and the voltages of the blue line and green line are both 0.3 V. In this state, a low level display signal voltage (0.3 V) is applied to the red line, and high level display signal voltages (4.3 V) are applied to the green line and the blue line.

At a time point of starting one horizontal scanning period, i.e., a time t21 where the horizontal synchronization signal HSYNC changes to high level from low level, the first switch control signal SW_RI changes to high level, and the second switch control signals SW_RO, SW_GO, and SW_BO change to high level. Therefore, a low level display signal applied to the red line, i.e., 0.3 V is applied to each of the red line, green line, and blue line.

Afterward, at a time t22, both of the second switch control signals SW_GO and SW_BO change to low level. Therefore, the green line and the blue line become a floating state, and 0.3 V of the prior voltage is held.

Next, at a time t23, the first switch control signal SW_RI changes to low level, and the first switch control signal SW_GI changes to high level. The second switch control signal SW_RO changes to low level, and the second switch control signal SW_GO changes to high level. Therefore, a high level display signal voltage which is 4.3 V is applied to the green line. However, as a time that the first switch control signal SW_GI and the second switch control signal SW_GO are being high level, i.e., a time TR2 of applying the display signal voltage to the green line is short, the voltage of the green line merely changes, for example, up to 3.9 V which is approximately 90% of the applied 4.3 V. The red line becomes a floating state, and holds 0.3 V of the prior voltage.

At this time, because of the interwiring capacitance Ca, the voltages of the adjacent red line and blue line change in accordance with the voltage change of the green line. Specifically, the voltage change ΔV of the green line is ΔV=3.6 V (=3.9 V−0.3 V), and according to the equation (1), the voltage fluctuation ΔE of an adjoining signal line Ls becomes 0.170 V. That is, the voltages of the red line and the blue line both change to 0.470 V (=0.3 V+0.170 V).

Next, at a time t24, the first switch control signal SW_GI changes to low level, and the first switch control signal SW_BI changes to high level. The second switch control signal SW_GO changes to low level, and the second switch control signal SW_BO changes to high level. Therefore, a high level display signal voltage which is 4.3 V is applied to the blue line. However, a time that the first switch control signal SW_BI and the second switch control signal SW_BO are being high level, i.e., a time TB2 of applying the display signal voltage to the blue line is short, the voltage of the blue line merely changes, for example, up to 3.9 V which is approximately 90% of the applied 4.3 V. The green line becomes a floating state, and holds 3.9 V of the prior voltage.

At this time, because of the interwiring capacitance Ca, the voltages of the adjacent red line and green line change in accordance with the voltage change of the blue line. Specifically, the voltage change ΔV of the blue line is ΔV=3.430 V (=3.9 V−0.470 V), and according to the equation (1), the voltage fluctuation ΔE of an adjoining signal line Ls becomes 0.161 V. That is, the voltage of the red line changes to 0.631 V (=0.470 V+0.161 V), and the voltage of the green line changes to 4.061 V (=3.9 V+0.161 V).

This is the first time application of the display signal voltage to each signal line Ls. Next, the second time application is performed.

That is, at a time t25, the first switch control signal SW_BI and the second switch control signal SW_BO change to low level, and the first switch control signal SW_RI and the second switch control signal SW_RO change to high level. Therefore, a low level display signal voltage which is 0.3 V is applied to the red line, and the voltage of the red line changes to 0.3 V.

At this time, the voltages of the adjacent green line and blue line change in accordance with the voltage change of the red line. That is, the voltage change ΔV of the red line is −0.331 V (=0.3 V−0.631 V), and according to the equation (1), the voltage fluctuation ΔE becomes −0.016 V. That is, the voltage of the green line changes to 4.045 V (=4.061 V−0.016 V), and the voltage of the blue line changes to 3.884 V (=3.9 V−0.016 V).

Subsequently, at a time t26, as similar to the time point of the time t23, the first switch control signal SW_RI and the second switch control signal SW_RO change to low level, and the first switch control signal SW_GI and the second switch control signal SW_GO change to high level. Therefore, a high level display signal voltage which is 4.3 V is applied to the green line. Because the prior voltage of the green line is 4.045 V, even if an application time TG2 is short, the voltage changes to 4.3 V.

At this time, the voltages of the adjacent red line and blue line change in accordance with the voltage change of the green line. That is, the voltage change ΔV of the green line is 0.255 V (=4.3 V−4.045 V), and according to the equation (1), the voltage fluctuation ΔE becomes 0.014 V. That is, the voltage of the red line changes to 0.314 V (=0.3 V+0.014 V), and the voltage of the blue line changes to 3.898 V (=3.884 V+0.014 V).

Next, at a time t27, as similar to the time point of the time t24, the first switch control signal SW_GI and the second switch control signal SW_GO change to low level, and the first switch control signal SW_BI and the second switch control signal SB_BO change to high level. Therefore, a high level display signal voltage which is 4.3 V is applied to the blue line. The previous voltage of the blue line is 3.898 V, so that even if the application time TB2 is short, the voltage changes to 4.3 V.

At this time, the voltages of the adjacent red line and green line change in accordance with the voltage change of the blue line. That is, the voltage change ΔV of the blue line is 0.402 V (=4.3 V−3.898 V), and according to the equation (1), the voltage fluctuation ΔE becomes 0.019 V. That is, the red line changes to 0.333 V (=0.314 V+0.019 V), and the green line changes to 4.319 V (=4.3 V+0.019 V).

After that, at a time t28, the second switch control signal SW_BO changes to low level. Therefore, the blue line becomes a floating state, and holds 4.3 V of the previous voltage.

Thus, at a time point of ending the horizontal scanning period, i.e., a time point just before a time t29 when the horizontal synchronization signal HSYNC changes to high level from low level, the voltages of the red line, the green line, and the blue line becomes 0.333 V, 4.319 V, and 4.3 V, respectively. In other words, with respect to the applied display signal voltage, the voltages change at 0.033 V for the red line, and 0.019 V for the green line.

The voltage fluctuation is about 1/10 times smaller than the conventional drive control method illustrated in FIGS. 6 and 7 (0.36 V for the red line, and 0.179 V for the green line). Therefore, the image degradation of a display image is significantly suppressed in comparison with the conventional drive method.

As mentioned above, in the embodiment, by performing application of the display signal voltage to each signal line Ls twice in one horizontal scanning period, it is possible to change the voltage of each signal line Ls to near the display signal voltage at the first time application, and reduce the voltage change ΔV of each signal line Ls originated from the second time application. This makes it possible to reduce the voltage fluctuation of a signal line adjacent to the signal line Ls. Accordingly, it is possible to reduce the fluctuation of the voltage of each signal line Ls at the time of ending the horizontal scanning period with respect to the applied display signal voltage, and suppress the image degradation of a display image.

[Operation and Effectiveness]

As explained above, according to the first embodiment, by performing the application of the display signal voltage to each signal line Ls twice in one horizontal scanning period, it is possible to reduce the fluctuation of the voltage of each signal line Ls at the time of ending the horizontal scanning period with respect to the applied display signal voltage. This enables suppression of the image degradation of a display image.

In FIG. 8, the application times TR2, TG2, and TB2 of the display signal voltages to the individual signal lines Ls are equal at the first time application and the second time application, but may be different time at the first time and the second time.

The application of the display voltage signal to each signal line Ls is performed twice in one horizontal scanning period, but may be performed more than or equal to three times.

FIG. 10 is a timing chart for a case where another drive control method of the first embodiment of the drive control method is applied.

In FIG. 10, a structure that application of the display signal voltage to each signal line Ls is performed three times in one horizontal scanning period is employed. In this case, the times TR2, TG2, and TB2 of applying the display signal voltage to each signal line Ls becomes short in comparison with a case where application is performed twice in one horizontal scanning period illustrated in FIG. 8.

Second Embodiment

Next, the second embodiment of the drive control method for the display device of the invention will be explained.

Figure 11:
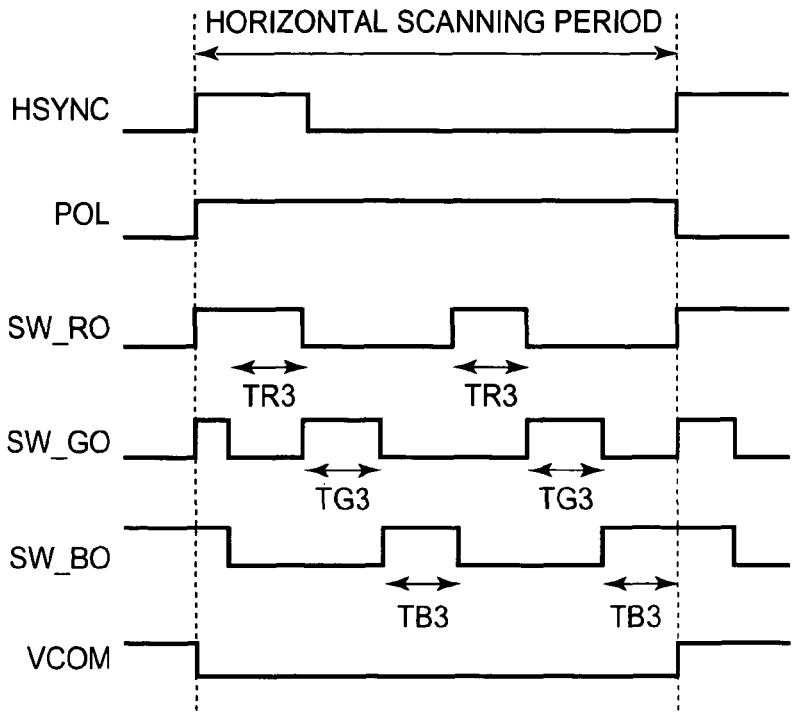
FIG. 11 is a timing chart for a case where the second embodiment of a drive control method is applied.

FIG. 11 is a timing chart for a case where the second embodiment of the drive control method is applied.

In the aforementioned first embodiment, the display operation of the liquid crystal display panel 10 is driven by the signal waveforms illustrated in FIG. 8, but in the second embodiment, the liquid crystal display panel 10 is driven by signal waveforms illustrated in FIG. 11.

In FIG. 11, beginning from the top, the waveforms of the horizontal synchronization signal HSYNC, the polarity control signal POL, the second switch control signal SW_RO, SW_GO, and SW_BO, and the common voltage signal VCOM are respectively illustrated.

As illustrated in FIG. 11, in the second embodiment, like in the first embodiment, application of the display signal voltage to each signal line Ls is performed twice in one horizontal scanning period. However, difference from the first embodiment is a point that the second time application of the display signal voltage ends simultaneously with the timing at which the horizontal scanning period ends. That is, in the second embodiment, all signal lines Ls become a non selected state, and there is no period to be a floating state.

As explained above, by performing controlling in such a way that all applications of the display signal voltage to each signal line Ls end at the timing at which the horizontal scanning period ends, it is possible to extend times TR3, TG3, and TB3 of applying the display signal voltages to individual signal lines Ls in comparison with the application times TR2, TG2, and TB2 of the first embodiment illustrated in FIG. 8.

Accordingly, in the second embodiment, at the time of the first time application of the display signal voltage, it is possible to have the voltage of each signal line Ls close to the display signal voltage further. This makes it possible to reduce the voltage change ΔV of each signal line originated from the second time application of the display signal voltage. Therefore, in the second embodiment, even if the interwiring capacitance Ca of a signal line Ls is further large, it is possible to suppress the image degradation of a display image.

In the first embodiment, the reason why a period that all signal lines Ls becomes a floating state after the second time application of the display signal voltage is provided is for providing a waiting time until charging is finished for carrying out sufficient charge to a corresponding pixel capacitor 14.

However, like this embodiment, in a case where application of the display signal voltage to each signal line Ls is performed twice in one horizontal scanning period, the voltage of each signal line Ls becomes a voltage close to the applied display signal voltage by the first time application, and charging to the pixel capacitor 14 is almost finished. Accordingly, there does not arises a problem that even if a period of making all signal lines Ls be a floating state after the end of the second time application of the display signal voltage is shorten or not provided at all.

In a case where a three division time-shared drive is employed as illustrated in FIG. 11, for the blue line, particularly, a period of finishing charging in a floating state is not provided after the second time application of the display signal voltage ends, but in normal, the display signal voltage merely changes largely for each horizontal scanning period, and it becomes a state where approximately the same display signal voltage is applied across one horizontal scanning period to the next horizontal scanning period, so that it is not particularly a problem.

Likewise, in a case where application of the display signal voltage to each signal line Ls is performed more than or equal to three times in one horizontal scanning period, the final application may be controlled in such a manner as to end simultaneously with the timing at which the horizontal scanning period ends.

Third Embodiment

Figure 12:
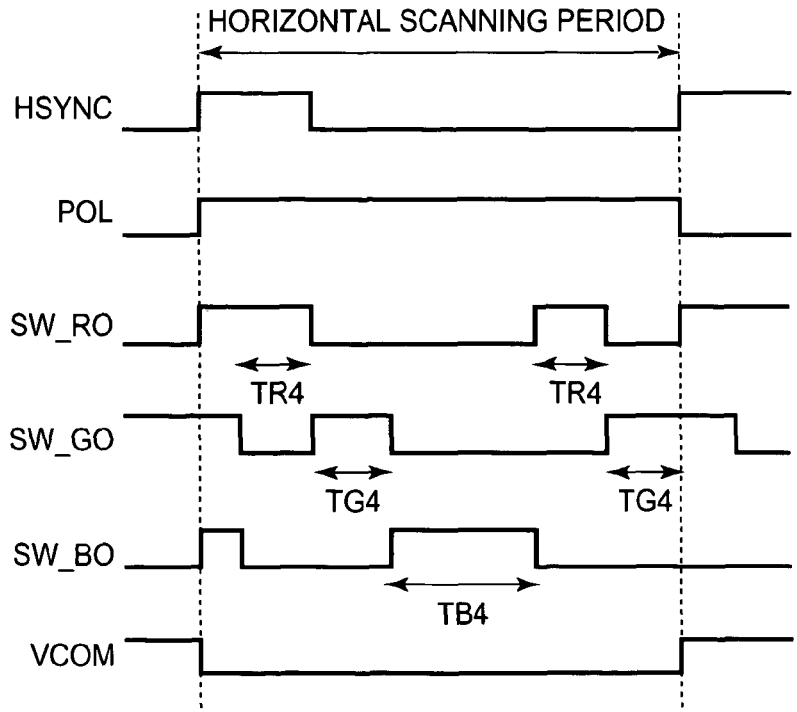
FIG. 12 is a timing chart for a case where the third embodiment of a drive control method is applied.

Next, the third embodiment of the drive control method for the display device of the invention will be explained. FIG. 12 is a timing chart for a case where the third embodiment of the drive control method is applied.

In the aforementioned second embodiment, the display operation of the liquid crystal display panel 10 is driven by the signal waveforms illustrated in FIG. 11, but in the third embodiment, it is driven by signal waveforms illustrated in FIG. 12.

In FIG. 12, beginning from the top, the waveforms of the horizontal synchronization signal HSYNC, the polarity control signal POL, the second switch control signals SW_RO, SW_GO, and SW_BO, and the common voltage signal VCOM are illustrated.

As illustrated in FIG. 12, in the third embodiment, a two division time-shared drive is performed like in the second embodiment, and for the red line and the green line, application of the display signal voltage is performed twice in one horizontal scanning period. The second time application of the display signal voltage terminates simultaneously with the timing at which the horizontal scanning period ends. Difference from the second embodiment is a point that the second time application of the display signal voltage to the red line and the green line is performed but the second time application of the display signal voltage to the blue line which is the last one in the application order is not performed.

A time TB4 of applying the display signal voltage to the blue line is longer than a time TR4 of applying the display signal voltage to the red line and a time TG4 of applying the display signal voltage to the green line, and it set as a time sufficient for allowing the voltage of the blue line to reach the applied display signal voltage.

As explained above, by not carrying out the second time application of the display signal voltage to the blue line which is the last one in the application order, it is possible to extend the application times TR4, TG4, and TB4 in comparison with the application times TR3, TG3, and TB3 illustrated in FIG. 11. Accordingly, even if the interwiring capacitance Ca of a signal line is further large, it is possible to suppress the image degradation of a display image.

The reason why the second time application of the display signal voltage to the blue line which is the last one in the application order is because the affection of a voltage change in an adjoining signal line Ls is small. The voltage of the blue line after the first time display signal voltage is applied fluctuates in accordance with a voltage change ΔV originated from the second time application of the display signal voltage to each of the adjacent red line and green line. The second time voltage change ΔV is, however, small as mentioned above, so that even if the second time application of the display signal voltage to the blue line is not performed, the fluctuation of the voltage of the blue line after the first time display signal voltage is applied is small. Accordingly, if it is set in such a way that the first time application of the display signal voltage to the blue line is sufficiently long and the voltage of the blue line reaches the display signal voltage, it is fine not to perform the second time application to the blue line which is the last one in the application order.

In the embodiment, an application of the display signal voltage is performed in the order of the red line, the green line, and the blue line in one horizontal scanning period, but the application is not limited to this case, and may be arbitrary. Likewise, in the case where application of the display signal voltage to each signal line Ls is performed more than or equal to three times in one horizontal scanning period, it is possible to perform controlling in such a way that application to a signal line which is the last in the application is not carried out at the time of the last application.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based upon and claims the benefit of priority from the prior Japanese Patent Application No. 2005-163874, filed Jun. 3, 2005, the entire contents of which is incorporated herein by reference.

What is claimed is:

1. A display drive device which drives a display panel having a plurality of signal lines and a plurality of scan lines, based on display data for a plurality of color components, wherein each of the signal lines corresponds to one of the plurality of color components and wherein the plurality of signal lines are divided into a plurality of groups, the display drive device comprising:

a data holding section which captures the display data for the plurality of color components and holds the captured display data separated by color component; and selection circuit sections provided for each group of signal lines, wherein the number of groups of signal lines is equal to the number of color components of the display data, and wherein each group of signal lines corresponds to a different color component, the selection circuit sections sequentially converting color components of the display data held by the data holding section into display signal voltages in a time sharing manner and applying the converted display signal voltages to each corresponding group of signal lines, wherein the selection circuit sections apply, plural times within one horizontal scanning period, a display signal voltage to at least a group of signal lines corresponding to a color component that is to be converted first during each horizontal scanning period, wherein the selection circuit sections apply, in a predetermined order, display signal voltages which correspond to color components of the display data, to each corresponding group of signal lines, and wherein the selection circuit sections perform voltage application such that the number of times of voltage application to a group of signal lines to which a display signal voltage is to be applied last in the predetermined order, is smaller than the number of times of voltage application to any other group of signal lines.

2. The display drive device according to claim 1, wherein the selection circuit sections apply, in a predetermined order, display signal voltages which correspond to color components of the display data, to each corresponding group of signal lines, and wherein the selection circuit sections repeat voltage application in the predetermined order, plural times within one horizontal scanning period.

3. The display drive device according to claim 2, wherein the display data is data for displaying red, green, and blue components, and wherein the selection circuit sections apply the display signal voltages to groups of signal lines corresponding thereto in an order of lines of a red component, lines of a green component, and lines of a blue component.

4. The display drive device according to claim 1, wherein:

the selection circuit sections perform voltage application such that one application time of applying a display signal voltage to a group of signal lines to which a display signal voltage is to be applied last in the predetermined order, is longer than one application time for any other group of signal lines.

5. The display drive device according to claim 1, wherein the selection circuit sections set, for each voltage application, a different application time to at least one group of signal lines to which a display signal voltage is applied plural times within one horizontal scanning period.

6. The display drive device according to claim 1, wherein the selection circuit sections have a period of applying display signal voltages to all corresponding groups of signal lines, prior to starting application of the display signal voltages in a time sharing manner.

7. The display drive device according to claim 1, wherein the display data is digital signals, and the display signal voltages are analog signals.

8. A display drive device which drives a display panel having a plurality of signal lines and a plurality of scan lines, based on display data for a plurality of color components, wherein each of the signal lines corresponds to one of the plurality of color components and wherein the plurality of signal lines are divided into a plurality of groups, the display drive device comprising:

a data holding section which captures the display data for the plurality of color components and holds the captured display data separated by color component;

data conversion sections provided for each group of signal lines, wherein the number of groups of signal lines is equal to the number of color components of the display data, and wherein each group of signal lines corresponds to a different color component, the data conversion sections repeatedly converting color components of the display data held by the data holding section into display signal voltages in a predetermined order, plural times within one horizontal scanning period; and selection circuit sections which sequentially apply, in a predetermined order, a display signal voltage acquired by the data conversion section to a corresponding group of signal lines in a time sharing manner;

wherein the selection circuit sections perform voltage application such that the number of times of voltage application to a group of signal lines to which a display signal voltage is to be applied last in the predetermined order, is smaller than the number of times of voltage application to any other group of signal lines.

9. A display device which displays image information based on display data for a plurality of color components, the display device comprising:

a display panel having a plurality of signal lines and a plurality of scan lines, wherein each of the signal lines corresponds to one of the plurality of color components and wherein the plurality of signal lines are divided into a plurality of groups;

a data holding section which captures the display data for the plurality of color components and holds the captured display data separated by color component; and selection circuit sections provided for each group of signal lines, wherein the number of groups of signal lines is equal to the number of color components of the display data, and wherein each group of signal lines corresponds to a different color component, the selection circuit sections sequentially converting color components of the display data held by the data holding section into display signal voltages in a time sharing manner and applying the converted display signal voltages to corresponding groups of signal lines, wherein the selection circuit sections apply, plural times within one horizontal scanning period, a display signal voltage to at least a group of signal lines corresponding to a color component that is to be converted first during each horizontal scanning period, wherein the selection circuit sections apply, in a predetermined order, display signal voltages which correspond to color components of the display data, to each corresponding group of signal lines, and wherein the selection circuit sections perform voltage application such that the number of times of voltage application to a group of signal lines to which a display signal voltage is to be applied last in the predetermined order, is smaller than the number of times of voltage application to any other group of signal lines.

10. The display device according to claim 9, wherein the selection circuit sections apply, in a predetermined order, display signal voltages which correspond to color components of the display data, to each corresponding group of signal lines, and wherein the selection circuit sections repeat voltage application in the predetermined order, plural times within one horizontal scanning period.

11. The display device according to claim 10, wherein the display data is data for displaying red, green, and blue components, and wherein the selection circuit sections apply the display signal voltages to groups of signal lines corresponding thereto in an order of lines of a red component, lines of a green component, and lines of a blue component.

12. The display device according to claim 9, wherein the selection circuit sections perform voltage application such that one application time of applying a display signal voltage to a group of signal lines to which a display signal voltage is to be applied last in the predetermined order, is longer than one application time for any other group of signal lines.

13. The display device according to claim 9, wherein the selection circuit sections set, for each voltage application, a different application time to at least one group of signal lines to which a display signal voltage is applied plural times within one horizontal scanning period.

14. The display device according to claim 9, wherein the selection circuit sections have a period of applying display signal voltages to all corresponding groups of signal lines, prior to starting application of the display signal voltages in a time sharing manner.

15. A display device which displays image information based on display data for a plurality of color components, the display device comprising:

a display panel having a plurality of signal lines and a plurality of scan lines, wherein each of the signal lines corresponds to one of the plurality of color components and wherein the plurality of signal lines are divided into a plurality of groups;

a data holding section which captures the display data for the plurality of color components and holds the captured display data separated by color component;

data conversion sections provided for each group of signal lines, wherein the number of groups of signal lines is equal to the number of color components of the display data, and wherein each group of signal lines corresponds to a different color component, the data conversion sections repeatedly converting color components of the display data held by the data holding section into display signal voltages in a predetermined order, plural times within one horizontal scanning period; and selection circuit sections which sequentially apply, in a predetermined order, a display signal voltage acquired by the data conversion section to a corresponding group of signal lines in a time sharing manner, wherein the selection circuit sections perform voltage application such that the number of times of voltage application to a group of signal lines to which a display signal voltage is to be applied last in the predetermined order, is smaller than the number of times of voltage application to any other group of signal lines.

16. A method of driving a drive display device which drives a display panel having a plurality of signal lines and a plurality of scan lines, based on display data for a plurality of color components, wherein each of the signal lines corresponds to one of the plurality of color components, wherein the plurality of signal lines are divided into a plurality of groups, wherein each group of signal lines corresponds to a different color component, and wherein the number of groups of signal lines is equal to the number of color components of the display data, the method comprising:

capturing the display data for the plurality of color components and holding the captured display data separated by color component; and sequentially converting color components of the held display data into display signal voltages in a time sharing manner and applying the converted display signal voltages to corresponding groups of signal lines, wherein a display signal voltage is applied to at least a group of signal lines corresponding to a color component that is to be converted first during each horizontal scanning period, plural times within one horizontal scanning period, wherein display signal voltages, which correspond to the color components, are applied in a predetermined order to groups of signal lines corresponding thereto, and wherein voltage application is performed such that the number of times of voltage application to a group of signal lines to which a display signal voltage is to be applied last in the predetermined order, is smaller than that of voltage application to any other group of signal lines.

17. The method of driving the display drive device according to claim 16, wherein display signal voltages, which correspond to color components of the display data, are applied in a predetermined order to each corresponding group of signal lines, and wherein voltage application is repeated plural times in the predetermined order within one horizontal scanning period.

18. The method of driving the display drive device according to claim 17, wherein the display data is data for displaying red, green, and blue components, and wherein the display signal voltages are applied to groups of signal lines corresponding thereto in an order of lines of a red component, lines of a green component, and lines of a blue component.

19. The method of driving the display drive device according to claim 16, wherein voltage application is performed such that one application time of applying a display signal voltage to a group of signal lines to which a display signal voltage is to be applied last in the predetermined order, is longer than one application time for any other group of signal lines.

20. The method of driving the display drive device according to claim 16, wherein, for each voltage application, a different application time is set to at least one group of signal lines to which a display signal voltage is applied plural times within one horizontal scanning period.

21. The method of driving the display drive device according to claim 16, further comprising a period of applying display signal voltages to all corresponding groups of signal lines, prior to starting application of the display signal voltages in a time sharing manner.

* * * * *